US008128015B2

(12) United States Patent
Sears

(10) Patent No.: US 8,128,015 B2
(45) Date of Patent: Mar. 6, 2012

(54) TOOL MOUNTING

(75) Inventor: Todd A. Sears, Oregon City, OR (US)

(73) Assignee: SSI Shredding Systems, Inc., Wilsonville, OR (US)

( * ) Notice: Subject to any disclaimer, the term of this patent is extended or adjusted under 35 U.S.C. 154(b) by 372 days.

(21) Appl. No.: 12/217,187

(22) Filed: Jul. 2, 2008

(65) Prior Publication Data

US 2009/0014570 A1 Jan. 15, 2009

Related U.S. Application Data

(60) Provisional application No. 60/959,271, filed on Jul. 11, 2007.

(51) Int. Cl.
*B02C 18/18* (2006.01)

(52) U.S. Cl. ..... 241/294

(58) Field of Classification Search ..... 241/293, 241/294, 295, 235, 236
See application file for complete search history.

(56) References Cited

U.S. PATENT DOCUMENTS

| | | | | | |
|---|---|---|---|---|---|
| 2,874,912 | A * | 2/1959 | Sennholtz et al. | ..... | 241/197 |
| 3,014,266 | A * | 12/1961 | Pettit et al. | ..... | 29/895.212 |
| 3,931,935 | A | 1/1976 | Holman | | |
| 4,046,324 | A | 9/1977 | Chambers | | |
| 4,352,774 | A * | 10/1982 | Hornberger | ..... | 264/263 |
| 4,374,573 | A | 2/1983 | Rouse et al. | | |
| 4,394,983 | A | 7/1983 | Ulsky | | |
| 4,600,158 | A | 7/1986 | Matoba | | |
| 4,678,126 | A | 7/1987 | Prentice et al. | | |
| 4,854,508 | A | 8/1989 | Dicky | | |
| 4,993,648 | A | 2/1991 | Torp | | |
| 5,100,070 | A * | 3/1992 | Montgomery, Sr. | ..... | 241/294 |
| 5,992,777 | A | 11/1999 | Aagaard | | |
| 6,375,106 | B1 * | 4/2002 | Sears | ..... | 241/294 |
| 6,523,767 | B1 * | 2/2003 | Ramesohl | ..... | 241/293 |
| 2004/0154171 | A1 * | 8/2004 | Utz et al. | ..... | 30/367 |
| 2006/0086854 | A1 | 4/2006 | Diemunsch | | |

* cited by examiner

*Primary Examiner* — Faye Francis
(74) *Attorney, Agent, or Firm* — Jon M. Dickinson, Esq.; Robert D. Varitz, Esq.

(57) ABSTRACT

A cutter assembly for a rotary, shear-type shredder including a cutting-tool carrier having a body possessing a rotational axis, a shear cutting tool, and a generally radial, sliding-friction-type, heat-cycle, binding interface removably anchoring the tool to the carrier body. This assembly is made by (a) forming a projection on one of the tool and the carrier, (b) forming a generally complementary, projection-receiving void space in the other of the tool and the carrier, whereby the projection and the void space nominally have an interference-fit relationship relative to one another, (c) creating a temperature differential between the tool and the carrier to an extent producing a clearance-fit relationship therebetween, (d) following that creating, fitting the projection snugly inside the void space, (e) reducing the created temperature differential toward zero, and (f) thereby establishing a robust, linear-sliding-friction anchoring interface between the tool and the carrier.

1 Claim, 2 Drawing Sheets

TOOL MOUNTING

CROSS REFERENCE TO RELATED APPLICATION

This application claims priority to the filing date, Jul. 11, 2007, of U.S. Provisional Patent Application 60/959,271, covering an invention entitled "Tool Mounting". The entire disclosure content of that provisional application is hereby incorporated herein by reference.

BACKGROUND AND SUMMARY OF THE INVENTION

This invention relates to structure and methodology regarding the installing, removing, and replacing of a wearable/replaceable tool relative to an associated tool carrier. A preferred and best-mode embodiment of the invention is illustrated and described herein in the context of a perimeter-mount shear cutting tool and a power-driven, rotary tool carrier, which is designed removably to receive such a tool.

The invention, which, as will be seen, possesses utility in many environments and applications, has emerged specifically in the hostile world of rotary, impact, shear-type material shredders, such as tire shredders, wherein issues, such as frequent tool breakage, and short tool life-cycles, continue to plague shredder operators with costly and extended downtimes linked to worn or broken-tool issues.

Appropriate tool alignment in relation to its associated tool carrier is also often an issue requiring attention.

Rapid tool wear in the illustrative tire-shredder environment, especially in such an environment where the tires to be shredded include steel-belted tires, is normal and expected, but frequent tool breakage should not be so. Both wear and breakage in this setting are usually attributed chiefly to tool engagement with the steel-belting structure included in most, if not all, modern tires.

Regarding the issue of tool wear, a conventional, heavy-duty, rotary, shear-type shredder, such as the above-mentioned tire shredder, may possess up to several hundreds of carrier-mounted tools. Normally, these tools are plural-bolt (typically three) anchored to the perimeter of a rotary carrier, with the associated shredder possessing a large plurality of such carriers. Such carriers are laterally "stacked" adjacent one another on a power-driven support shaft. U.S. Pat. Nos. 3,931,935, 4,374,573, 4,854,508, and U.S. Patent Application Publication No. 2006/0086854 A1, the contents of which are referred to herein for background information purposes, illustrate this conventional environment.

In this environment, tool manufacturers routinely suggest, with respect to when a shredder is shut down to deal, for example, simply with a tool-wear situation involving one, or several, tools, that all tools be replaced at that time. Such tool replacement is a very large time commitment, especially where, for each tool, and as is frequently the case, plural anchoring bolts must be removed and later installed for each removed and replaced tool.

Tool breakage, which is normally linked to anchoring-bolt breakage, often results from the truth about, rather than the belief in, the robustness of the usual plural-bolt anchoring paradigm. A tool of the type described above is not really held in place at any moment in time by the combined strengths of the plural (typically three) normally employed anchoring bolts, i.e., bolts which can be counted upon collectively to hold until all three simultaneously fracture to define a tool break. Rather, such a tool is only anchored effectively by the "one-bolt-at-a-time" condition, wherein breaking-point is defined, at every moment in time, by merely the strength of a single bolt. When a first bolt to break does so, and this will always be the case (in the sense of there being just one tool-anchoring bolt which first fails), another one of the tool-anchoring, remaining, intact bolts will, each as a singularity, be next to fail, and so on, until a related tool is no longer secured to a carrier. Catastrophic tool breakage, per se, quickly follows.

Another important consideration is tool alignment on a carrier. Here, an issue which is associated with the usual, plural-bolt anchoring approach of the prior art relates to the necessarily required tolerance precision (a) of the anchoring bolt shanks, (b) of the provided, bolt-receiving throughbores included in prior art tools, and (c) of the needed bolt-thread receiving threaded wells formed for each tool on the perimeter of a carrier. Three general "regions" of such tolerance precision are thus linked to each and every usual prior art tool of the type mentioned above, and this condition presents a large challenge not only in relation to initial tool-to-carrier installation, but also in relation to every tool removal, and return or replacement, operation. Regarding the latter activity, precision-tolerance alignment issues surface predictively when "returned" bolts do not return to the exact locations from which they were removed, and certainly also whenever a new tool, and/or a new bolt, is/are installed to replace the old tool and/or an old bolt.

The present invention addresses all of the above-mentioned issues in practical, extremely effective, remarkably simple, and inexpensive ways.

Stated simply, and with more specificity, the invention features a heat-cool, shrink-bind tool/carrier mounting which is characterized (a) by the absence of any independent tool-to-carrier mounting hardware, per se, (b) by the attendant, reduced cost and material simplicity to which this absence leads, (c) by a fastening robustness which essentially obviates the likelihood of tool breakage, and which also, in the bargain, furnishes tool anchoring security and stability far surpassing those aspects of prior art approaches, (d) by precision, tool/carrier, operative alignment which is superior to that which is attainable in the prior art, and (e) by enabled styles of tool-carrier connection and disconnection that are remarkably quickly and easily performable.

These and other features and advantages which are offered by the present invention will become more fully apparent as the detailed description of the invention which now follows is read in conjunction with the accompanying drawings.

DETAILED DESCRIPTION OF THE INVENTION

Figure 1:
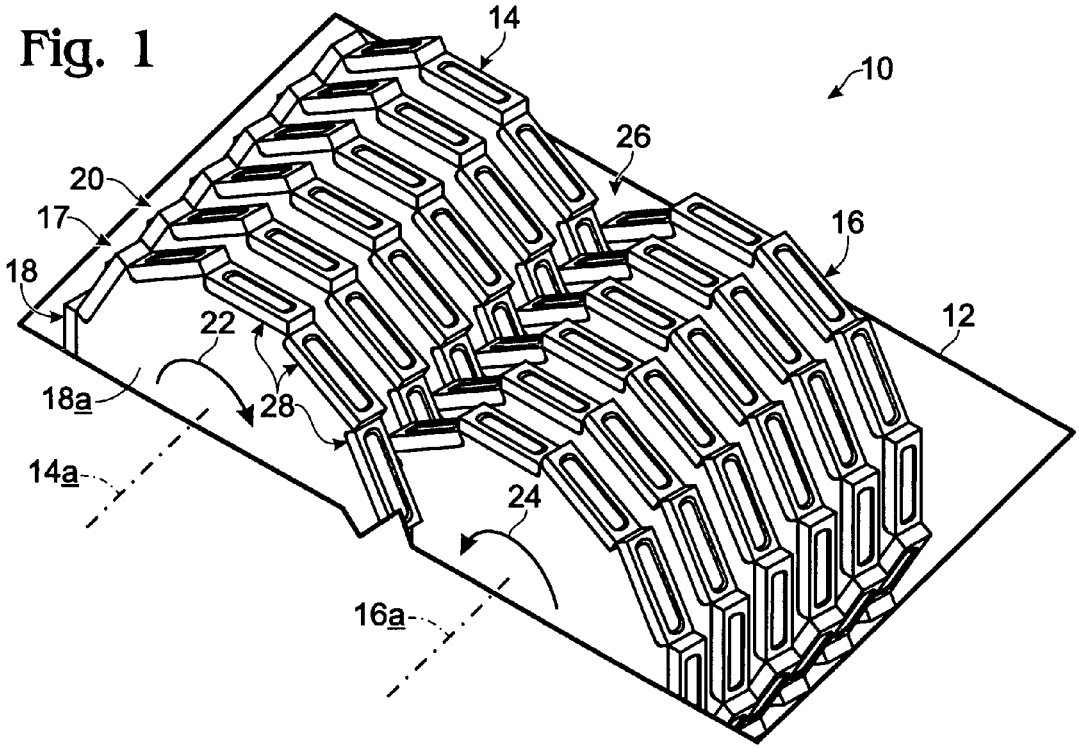
FIG. 1 is a fragmentary, downwardly-looking, isometric view of the shredding zone in a rotary, shear-type tire shredder employing plural cutter assemblies, each made in accordance with a preferred and best-mode embodiment of the invention.
Figure 2:
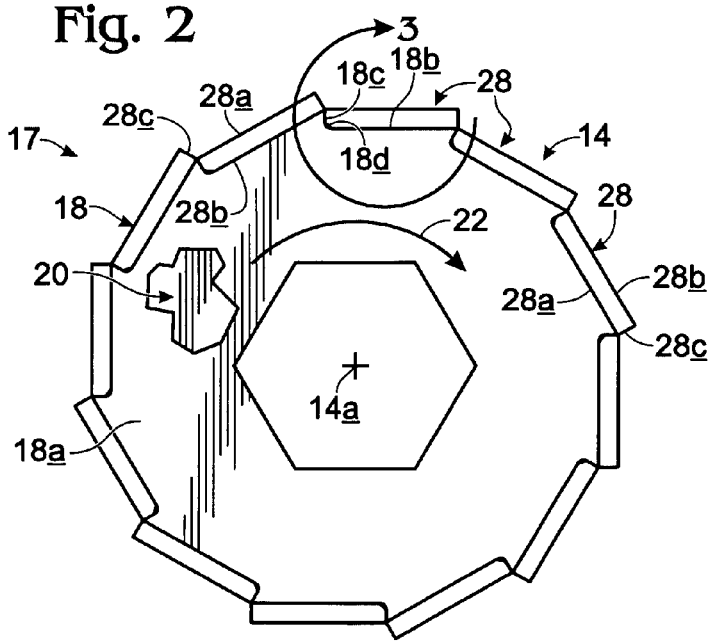
FIG. 2 is an axial view of one of the carrier/tool cutter assemblies employed in, but shown removed from, the shredder of FIG. 1.

Turning now to the drawings, and referring first of all to FIGS. 1 and 2, indicated generally at 10 in FIG. 1 is a rotary, shear-type vehicle tier shredder of the kind which is capable of handling steel-belted tires. Shredder 10, which is shown only in fragmentarily in FIG. 1, includes a frame 12 on which are appropriately mounted two, power-driven, rotary, cutter-assembly stacks 14, 16, each including plural (six herein) rotary cutter assemblies, such as the two cutter assemblies which are shown at 17, 20 in stack 14. The respective cutter assemblies in stacks 14, 16 are appropriately mounted on and connected to power-driven rotary shafts (not shown) for counter-rotation as indicated by arrows 22, 24, respectively, about rotational axes 14*a*, 16*a*, respectively. Tires which are to be shredded by and within shredder 10 are fed thereinto appropriately as is indicated generally by arrow 26 in FIG. 1.

Each cutter assembly in shredder 10 has substantially the same construction. Accordingly, and referring specifically to cutter assembly 17 in stack 14, this assembly includes what is referred to herein as a rotary cutting-tool carrier, or carrier structure, 18 possessing a generally circular, central steel body 18*a* having a nominal outside diameter herein of about 20-inches, and an axial thickness of about 1⅝-inches. The rotational axis of assembly 18 and body 18*a* is previously mentioned axis 14*a*.

Carrier body 18*a* may be thought of as being generally planar with its nominal plane lying generally in the plane of FIG. 2 in the drawings. The periphery of body 18*a* has a somewhat saw-tooth configuration as seen in FIG. 2, with this saw-tooth configuration being defined by plural, angularly-displaced, elongate platforms 18*b*, which join generally at right angles with short, generally radially outwardly extending shoulders 18*c*. The region of joinder between each shoulder-intersecting platform and shoulder is slightly radiused, as indicated generally at 18*d*. In the particular cutter-assembly construction 17 which is now being described, each platform 18*b* has a length of about 5-inches, and each shoulder 18*c* has a "radial" a depth of about 1-inches.

Mounted, as will shortly be described, in accordance with the features of the present invention, on the platforms and adjacent the shoulders formed at the saw-tooth periphery of carrier body 18*a*, are elongate, generally rectangular-outline, shear cutting tools, or tool structures, 28. The outside configuration of each shear cutting tool 28 has (a) a length of about 5-inches, which is substantially the same as the length of previously-mentioned carrier-body platforms 18*b*, (b) a width which substantially matches the axial thickness of carrier body 18*a*, and (d) a thickness, generally measured in a radial direction relative to rotational axis 14*a*, which is about the same as the "radial" depth-dimension of previously mentioned shoulders 18*c*.

Each cutting tool 28 possesses a pair of what are referred to herein as radially-spaced, opposite faces, including an outer face 28*a*, and an inner face 28*b*. Each tool also possesses an appropriately hardened cutting face 28*c*, and a rear, underside, lateral chamfer 28*d* which furnishes clearance for previously mentioned radiused regions 18*d* under circumstances with the tool mounted in place on a platform in carrier 18. Inner face 28*b*, with each tool 28 appropriately mounted in place on carrier body 18*a*, lies confrontingly and contactively adjacent carrier-body platform 18*b*.

Lying at the heart of the present invention is the "operative-condition" releasable locking connection which exists between a tool carrier, such as carrier 18, and a cutting tool, such as tools 28. This connection is referred to herein in several different manners, including (a) two-component, releasable interconnection, (b) reversible, heat-cycle, binding interface, and (c) post-and-socket, heat-cycle-implemented, reversible, linear-sliding-friction binding interface.

Figure 3:
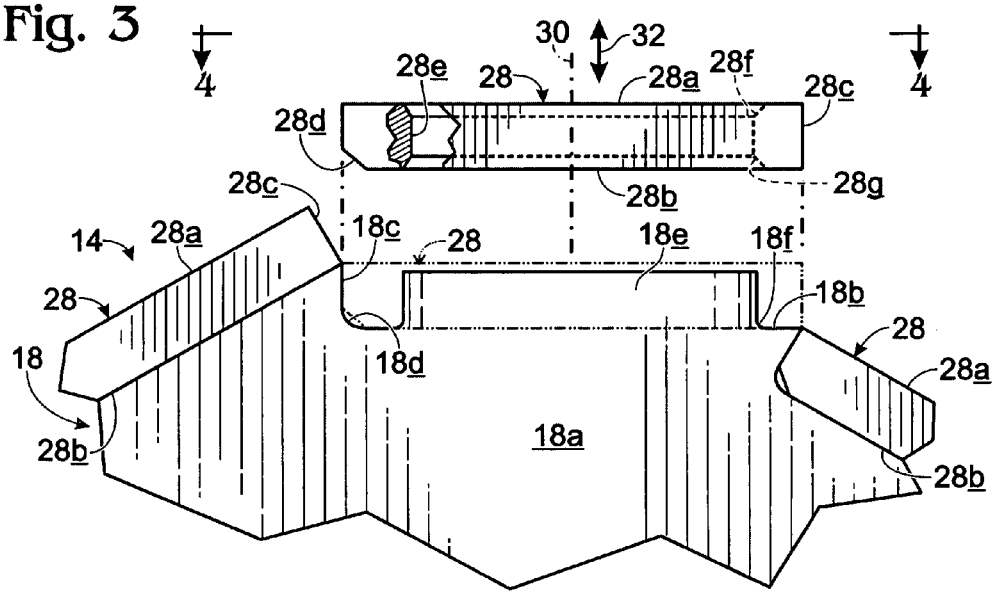
FIG. 3 is a larger-scale view of the region in FIG. 2 which is embraced by curved arrows 3-3. One cutting tool in this figure is shown in a removed/not-installed disposition relative to the illustrated rotary tool carrier.
Figure 4:
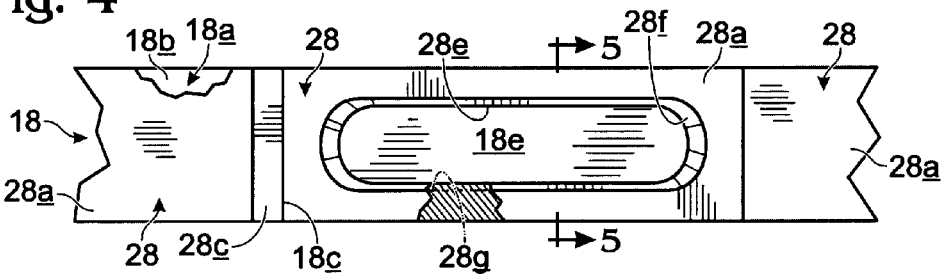
FIG. 4 is a fragmentary, perimetral plan view taken generally along the line 4-4 in FIG. 3, with all illustrated tools (three) in place on the illustrated carrier.
Figure 5:
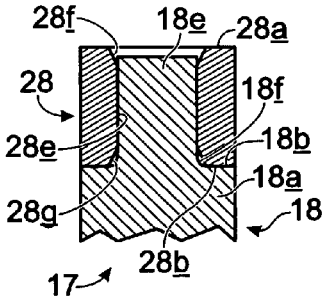
FIG. 5 is a fragmentary cross section taken generally along the line 5-5 in FIG. 4.

Connection and disconnection between a carrier and a tool, soon to be described, take place along a linear, generally radial (in relation to a rotational axis, such as axis 14*a*) line 30 (see FIG. 3) of connection and disconnection, and as indicated by double-headed arrow 32 in FIG. 3. When a tool and a tool carrier are operatively connected and anchored to one another, the binding interface which exists between them is one of substantial, indeed extreme, lateral compression, as will be explained below—a lateral compression which is also referred to herein as heat-releasable, tool-gripping, lateral compression. This lateral compression exists in what is in fact an extremely tightly locked, sliding interface which will now be described.

Continuing with reference specifically to cutter assembly 18, the binding interface of the present invention is created by interaction between an elongate, oblong, radially outwardly extending, rounded-end projection 18*e* which is formed centrally on each platform 18*b* in carrier 18, and a "nearly complementary" (regarding fit), elongate, oblong, rounded-end, projection-receiving void space 28*e* which is formed as a central through-passage in each tool 28—a through-passage which opens to spaced faces 28*a*, 28*b* in each tool. Where each void space 28*e* opens to faces 28*a*, 28*b*, it is chamfered as indicated at 28*f*, 28*g*, respectively. A radiused region 18*f* exists around the location of joinder of projection 18*e* and platform 18*b*. Chamfer 28*g* furnishes clearance for this region under circumstances where a tool 28 is properly mounted on a platform 18*b*.

This just-mentioned, "nearly complementary" relationship which exists between a projection and a void space is based upon what is referred to herein as "nominal", equal-temperature dimensions that characterize each projection and void space. In the cutter-assembly configuration which is now being described, the long, "nominal", equal-temperature dimension of each projection 18*e* is about 0.001-inches longer than the long, "nominal", equal-temperature dimension of each void space 28*e*, and the smaller, lateral, "nominal", equal-temperature dimension of each projection is up to about 0.008-inches larger than the associated, smaller, lateral, "nominal", equal-temperature dimension of each void space.

Figure 6:
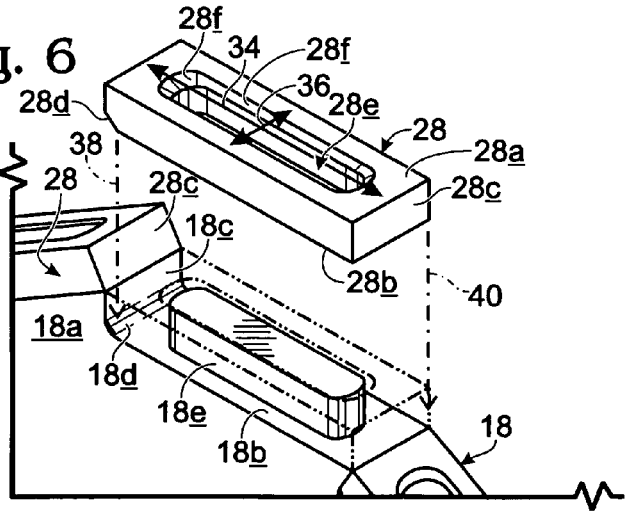
FIG. 6 is an exploded, isometric view based upon the illustrations of FIGS. 4 and 5. Solid-line and phantom-line, differentiated, relative positions are shown for the pictured carrier fragment and tools to help illustrate the preferred and best-mode manners of practicing the methodology of the present invention.

Adding reference now to FIG. 6 along with the other drawing figures, the characteristics and the establishment of the important releasable, sliding-friction, tool/carrier, locking connection/interface which exists in accordance with the practice of the present invention is now described.

As was mentioned earlier, when a tool carrier and a tool reside at substantially the same temperature, there exists the above-mentioned "nearly complementary" fit-relationship between a projection, such as projection 18*e* and a void space, such as void space 28*e*. This nearly complementary relationship between these two interactive structures is such that it is, only with extreme difficulty, possible to press-fit an unconnected tool (i.e., its void space) onto an exposed projection, such as projection 18*e*.

To mount a tool on a carrier body in accordance with practice of the present invention, preferably, a carrier body resides nominally at normal, ambient, room temperature. The tool which is to be mounted in place on a platform in that carrier is then appropriately heated to a temperature typically somewhere in the range of about 600°- to about 800°-Fahrenheit. Such tool heating may be performed in any suitable manner, as by placing the tool in an appropriate oven, or by heating it utilizing a conventional electromagnetic induction heating device.

With the tool so heated, both the long dimension, and smaller, lateral dimension, of the tool void space expand as is indicated generally by the two double-headed arrows 34, 36, respectively, in FIG. 6, and this expansion is sufficient to afford a clearance-fit relationship between the tool void space and a projection 18*e*. Under this condition, and through appropriate tool handling, the tool is simply lowered into place on a carrier body as is indicated generally by dash-dot arrows 38, 40 in FIG. 6. Final and appropriate seating of the tool in place on the now associated carrier-body platform 18*b* may be accomplished by modestly hammer-tapping the tool downwardly toward the platform to assure appropriate contact seating.

The thus mounted tool is allowed now simply to cool, and in the process of cooling, quickly shrinks in dimension to become robustly bound and anchored in place with an extremely high-compression interface then existing between a projection 18*e* and the associated tool void space 28*d*.

When it comes time to replace a worn the tool, for example, the tool-mounting process which has just been described above is effectively reversed. More specifically, a tool which is to be removed is heated, preferably by an induction heating device, to cause its dimensions to swell sufficiently to allow it to be pried free from its mounted condition on the associated carrier body. This activity in no way disturbs the accurate positioning of the carrier-body projection on which the now-removed tool was once mounted, and a new, replacement tool is then mounted in place on the same projection, utilizing the mounting technique described above.

There and have thus now been described and illustrated a unique tool mounting methodology and resulting structure which clearly deal with all of the prior-art issues mentioned earlier herein. Put another way, experience has shown that such a tool mounting effectively successfully resolves the tool-breakage issues mentioned above, greatly minimizes the number of activities which need to be involved with respect to original tool mounting and subsequent tool demounting and replacement, significantly reduces the number of components employed in a tool-mounting situation, and additionally, results predictably in extremely accurate relative positioning between a tool and a carrier body. Such precision is offered, at least in part, by the positional and configuration stability of a projection intended to receive the void space in a mounted tool.

The releasable locking connection which is producible, in accordance with practice of the present invention, between a tool and a carrier body, is one wherein connection and disconnection take place via relative movement of the tool and carrier body toward and away from one another along a predetermined, generally radial, line of action. The releasable locking which occurs to create the robust connection established by the present invention is defined by compressive-force interaction between the mentioned projection and the mentioned void space, with such interaction existing along at least one other line, and in fact along many other lines, which is/are generally orthogonally related to the line along which the mentioned relative movement takes place during connecting and disconnecting activity. The resulting tool-gripping, lateral compression which exists between a mounted tool and a carrier body thus becomes a consequence of what might be thought of as being induced, transitory, thermal-transition, relative-dimensional change between a carrier-body projection and a tool void space.

Accordingly, while a preferred and best-mode embodiment of, and manner of practicing, the invention have been clearly illustrated and discussed herein, it is appreciated that variations and modifications may be made without departing from the spirit of the invention.

I claim:

1. A cutter assembly for a rotary shear shredder comprising a plural-cutting-tool, rotary carrier having a body possessing a rotational axis and a plural-tool-carrying periphery distributed about said axis, for each tool which is to be carried by said carrier, an associated, radially-outwardly-extending, radial projection formed at a location on and projecting from said periphery, for each said projection, an associated shear cutting tool having radially spaced, opposite faces, a projection-receiving void space, complementary to said projection, formed in each said tool and opening to each of said faces, and, defined collectively by and for each associated, projection and complementary void space, a sliding-friction, reversible-heat-cycle, connection/disconnection, binding interface removably anchoring said tool directly to said carrier body at said location, and accommodating connection and disconnection between the carrier body and said tool along a line which is radial relative to said rotational axis.

* * * * *